United States Patent [19]

Leib et al.

[11] 4,242,394

[45] Dec. 30, 1980

[54] REINFORCED PRIMARY BACKING FOR TUFTED PILE FABRICS

[75] Inventors: Ronald J. Leib; Moses Sparks, Jr., both of Lancaster, Pa.

[73] Assignee: Armstrong Cork Company, Lancaster, Pa.

[21] Appl. No.: 55,893

[22] Filed: Jul. 9, 1979

[51] Int. Cl.[3] ..... D04H 11/00; D04H 11/08

[52] U.S. Cl. ..... 428/95; 428/234; 428/235; 428/247; 428/251; 428/252; 428/255; 428/256

[58] Field of Search ..... 428/95, 234, 235, 247, 428/251, 252, 255, 256

[56] References Cited

U.S. PATENT DOCUMENTS

| | | | |
|---|---|---|---|
| 1,722,764 | 7/1929 | Rasch | 428/234 |
| 3,394,043 | 7/1968 | Parlin | 428/95 |
| 3,806,401 | 4/1974 | Brinkhoff | 428/88 |
| 4,053,668 | 10/1977 | Kimmel | 428/95 |

*Primary Examiner*—Marion McCamish
*Attorney, Agent, or Firm*—Dennis M. Kozak

[57] ABSTRACT

A reinforced primary backing for tufted pile fabrics is disclosed. The reinforced primary backing comprises a non-woven fibrous capping layer, a reinforcing material layer, and a woven backing layer, said non-woven fibrous capping layer being positioned adjacent one side of said reinforcing material layer and said woven backing layer being positioned adjacent the other side of said reinforcing material layer, said non-woven fibrous capping layer being needled into and extending downward through said reinforcing material layer and continuing into and through said woven backing layer to the outside surface of said woven backing layer.

10 Claims, 1 Drawing Figure

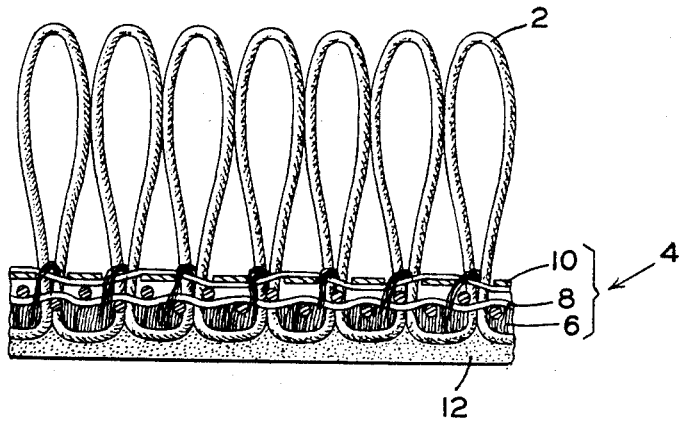
2
10
8
6
4
12

REINFORCED PRIMARY BACKING FOR TUFTED PILE FABRICS

This invention pertains generally to tufted pile fabrics and more particularly to a reinforced primary backing which facilitates the production of tufted pile fabric without the need for a secondary backing.

It is well known to make tufted carpets by forcing yarn through suitable primary backings. Typically, these primary backings comprise a woven or non-woven polypropylene scrim, positioned above and adhered to a woven jute or synthetic secondary backing scrim by a latex layer. This secondary backing is adhered to the primary backing after tufting and serves to increase the strength and the dimensional stability of the tufted fabric, that is, the secondary jute backing facilitates stretch-in installation of the tufted fabric without tearing the fabric and prevents wrinkling or buckling of the fabric after installation.

The present invention provides a reinforced primary backing for tufting which, when used without a secondary backing, can be stretch-in installed and exhibits excellent dimensional stability to mechanical actions after installation, and, accordingly, the reinforced primary backing of the invention eliminates the conventional need for a secondary backing.

According to this invention, there is provided a reinforced primary backing for tufted pile fabrics comprising a non-woven fibrous capping layer, a reinforcing material layer and a woven backing layer, said non-woven fibrous capping layer being positioned adjacent one side of said reinforcing material layer and said woven backing layer being positioned adjacent the other side of said reinforcing material layer, said non-woven fibrous capping layer being needled into and extending downward through said reinforced material layer and continuing into and through said woven backing layer to the outside surface of said woven backing layer.

Also, according to this invention, there is provided a tufted pile fabric comprising: (a) a reinforced primary backing comprising a non-woven fibrous capping layer, a reinforcing material layer and a woven backing layer, said non-woven fibrous capping layer being positioned adjacent one side of said reinforcing material layer and said woven backing layer being positioned adjacent the other side of said reinforcing material layer, said non-woven fibrous capping layer being needled into and extending through said reinforced material layer and continuing into and through said woven backing layer to the outside surface of said woven backing layer; and, (b) yarn tufted through said reinforced primary backing to define a tufted face yarn supported by and extending above said reinforced primary backing.

In one embodiment of this invention the nonwoven fibrous capping layer of the reinforced primary backing is positioned adjacent the tufted face yarn.

In a preferred embodiment, the woven backing layer of the reinforced primary backing is positioned adjacent the tufted face yarn.

In another embodiment the reinforcing material layer is a spunbonded fibrous sheet.

In another embodiment the reinforcing material layer is an extruded, oriented, open mesh netting.

In another embodiment the reinforcing material layer is a woven natural, semisynthetic, synthetic or metallic fiber scrim.

In a preferred embodiment of this invention the non-woven fibrous capping layer, the reinforcing material layer and the woven backing layer are all polypropylene.

Although the reinforced primary backing of this invention is designed to eliminate the need for a conventional secondary backing, one can be employed to provide a carpet backing having unusually better than normal dimensional stability to mechanical actions. If employed, a conventional secondary backing—e.g., woven jute—will be positioned adjacent the floor and joined to the reinforced primary backing by use of a convention adhesive.

In the embodiment in which the non-woven fibrous capping layer is adjacent the tufted face yarn, the secondary backing would be adhered to the woven backing layer.

In the embodiment in which the woven backing layer is adjacent the tufted face yarn, the secondary backing would be adhered to the non-woven fibrous capping layer.

The subject invention will be explained with reference to the attached drawing which is a cross-sectional view of a tufted fabric including the reinforced primary backing of this invention.

Referring now to the drawing, a tufted fabric in accordance with this invention has a plurality of tufts 2 which extend through pre-formed reinforced primary backing 4. The tufts 2 may be of any desired length and density and may be looped, as shown, or cut. The tufts 2 can be of any suitable material and typically will be nylon, polyester, or acrylic pile yarn.

The reinforcing primary backing 4 of this invention includes a non-woven fibrous capping layer 6, conventionally needled into and through reinforcing material layer 8 and continuing through woven backing layer 10 to the outside surface of woven backing layer 10 which in the drawing is positioned toward the face yarn. Preferably, to the surface of the reinforced primary backing positioned adjacent a substrate, namely, a floor, is applied a thin layer 12 of a conventional latex, hot melt adhesive, or cross-linkable adhesive.

Capping layer 6 can be a layer of any suitable staple fibers. The staple fibers making up the capping layer will typically be nylon, polypropylene, polyester fibers or mixtures thereof having lengths of from about $2\frac{1}{2}$ to about 3 inches and deniers of from about 3 to about 15.

Reinforcing material layer 8 can be any suitable natural, semisynthetic, synthetic or metallic fiber type scrim of any suitable weave configuration such as plain weave, twill weave and lenoweave construction.

As the reinforcing material layer use can also be made of extruded, oriented, open mesh nettings. A particularly suitable netting is a $6\times6$ count, extruded, open square mesh polypropylene netting commercially available from the Plastics Division of Conwed Corporation.

Also suitable for use as the reinforcing material layer are spunbonded fibrous sheets. A particularly suitable spunbonded fibrous sheet is designated "Typar" commercially available from the Dupont Company.

Typar is a web composed of randomly arranged, continuous filament polypropylene fibers, which are bonded at the filament crossover points.

Backing layer 10 can be any conventional woven backing scrim comprising synthetic or natural fibers. Preferably, backing layer 12 is a woven polypropylene ribbon scrim as taught in U.S. Pat. Nos. 3,605,666 and 3,817,817.

Reference is made to the following example which demonstrates the best mode for practicing this invention in the preparation of tufted carpeting.

EXAMPLE

A 16×8 count lenoweave polypropylene scrim (reinforcing material layer) was placed between a 2 ounce polypropylene non-woven fibrous capping layer and a 24×13 count polypropylene ribbon scrim woven backing layer.

The capping layer was needled through the polypropylene scrim and into and through the woven backing layer, using a conventional needle loom (178 penetrations per square inch, 15/32 inch depth of penetration and 395 strokes per minute) to produce a reinforced primary backing of this invention.

Into the resulting reinforced primary backing having the woven backing layer in the toward face yarn position was tufted nylon pile yarn to produce a ⅛ inch gauge, 28 ounce per square yard yarn weight, level loop, commingled yarn carpet. To the back (capping layer) of the resulting carpet was applied, at the rate of 28 ounces per square yard, a conventional carboxylated styrene-butadiene latex at a filler level of about 50 percent.

The resulting latex-backed carpeting was recovered as a tufted fabric of this invention and tested for dimensional stability to mechanical actions using the test method described in the article *The Dimensional Stability of Carpets in Installations,* Textile Research Journal, July 1977 pages 459–463 (herein incorporated by reference), with the following results: percent unrecovered lengthwise extension 0.71 and percent unrecovered widthwise extension 0.76.

The above data demonstrates that tufted carpet produced using the reinforced primary backing of this invention and no secondary backing exhibits a lengthwise plus widthwise, unrecovered extension of 1.47% which is well below the 2.0% established industry maximum for satisfactory performance. The 1.47% total unrecovered extension indicates that carpeting employing the reinforced primary backing of this invention would facilitate stretch-in installation and would exhibit excellent dimensional stability after installation.

It would be evident from the foregoing that various modifications can be made to this invention. Such, however, are considered to be within the scope of this invention.

What is claimed is:

1. A reinforced primary backing for tufted pile fabrics comprising a non-woven fibrous capping layer, a reinforcing material layer and a woven backing layer, said non-woven fibrous capping layer being positioned adjacent one side of said reinforcing material layer and said woven backing layer being positioned adjacent the other side of said reinforcing material layer, said non-woven fibrous capping layer being needled into and extending through said reinforcing material layer and continuing into and through said woven backing layer to the outside surface of said woven backing layer.

2. The reinforced primary backing of claim 1 wherein said reinforcing material layer is a spunbonded fibrous sheet.

3. The reinforced primary backing of claim 1 wherein said reinforcing material layer is an extruded, oriented, open mesh netting.

4. The reinforced primary backing of claim 1 wherein said reinforcing material layer is a woven natural, semi-synthetic, synthetic or metallic fiber scrim.

5. The reinforced primary backing of claim 1 wherein said non-woven fibrous capping layer, said reinforcing material layer and said woven backing layer are all polypropylene.

6. A tufted pile fabric comprising: (a) a reinforced primary backing comprising a non-woven fibrous capping layer, a reinforcing material layer, and a woven backing layer, said non-woven fibrous capping layer being positioned adjacent one side of said reinforcing material layer and said woven backing layer being positioned adjacent the other side of said reinforcing material layer, said non-woven fibrous capping layer being needled into and extending through said reinforcing material layer and continuing into and through said reinforcing material layer to the outside surface of said backing layer; and, (b) yarn tufted through said reinforced primary backing to define a tufted face yarn supported by and extending above said reinforced primary backing.

7. The tufted pile fabric of claim 6 wherein the non-woven fibrous capping layer of the reinforced primary backing is positioned adjacent the tufted face yarn.

8. The tufted pile fabric of claim 7 wherein a secondary backing is joined to the woven backing layer of the reinforced primary backing.

9. The tufted pile fabric of claim 6 wherein the woven backing layer of the reinforced primary backing is positioned adjacent the tufted face yarn.

10. The tufted pile fabric of claim 6 wherein a secondary backing is joined to the non-woven fibrous capping layer of the reinforced primary backing.

* * * * *